US006290315B1

(12) United States Patent
Sayama

(10) Patent No.: US 6,290,315 B1
(45) Date of Patent: Sep. 18, 2001

(54) METHOD OF DRIVING AN INK JET RECORDING HEAD

(75) Inventor: Tomohiro Sayama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/370,073

(22) Filed: Aug. 9, 1999

(30) Foreign Application Priority Data

Aug. 12, 1998 (JP) ..... 10-228438

(51) Int. Cl.[7] ..... B41J 29/38; B41J 2/045

(52) U.S. Cl. ..... 347/10; 347/9; 347/11; 347/68

(58) Field of Search ..... 347/9, 10, 11, 347/68

(56) References Cited

U.S. PATENT DOCUMENTS 4,523,200 6/1985 Howkins ..... 510/112
5,980,015 11/1999 Saruta ..... 347/15
6,079,806 * 6/2000 Wen et al. ..... 347/10
6,092,886 * 7/2000 Hosono ..... 347/10

FOREIGN PATENT DOCUMENTS

A2 0 721 840 7/1996 (EP) ..... B41J/2/045
A1 0 810 097 12/1996 (EP) ..... B41J/2/205
A2 0 827 838 3/1998 (EP) ..... B41J/2/21
09242203 * 3/1999 (JP) ..... B41J/2/01

* cited by examiner

*Primary Examiner*—Huan Tran
*Assistant Examiner*—Alfred E Dudding
(74) *Attorney, Agent, or Firm*—Sughrue, Mion, Zinn, Macpeak & Seas, PLLC

(57) ABSTRACT

In order to provide an inkjet recording head in which both high-speed printing and high-quality printing can be attained, a drive signal is generated so as to include a first expanding element and a successive second expanding element. Either a small-dot driving pulse including both of the expanding elements or a large-dot driving pulse including only the second expanding element is generated from the drive signal. The selection of one or the other driving pulse is based on the volume of the ink drop to be ejected.

17 Claims, 9 Drawing Sheets

| GRADATION VALUE | FIRST PULSE SEGMENT | SECOND PULSE SEGMENT | DECODED VALUE | |
|---|---|---|---|---|
| 1 (0 0) | ○ | × | (1 0) | FINE-VIBRATION PULSE |
| 2 (0 1) | ○ | ○ | (1 1) | SMALL-DOT DRIVING PULSE |
| 3 (1 0) | × | ○ | (0 1) | LARGE-DOT DRIVING PULSE |

FIG. 9
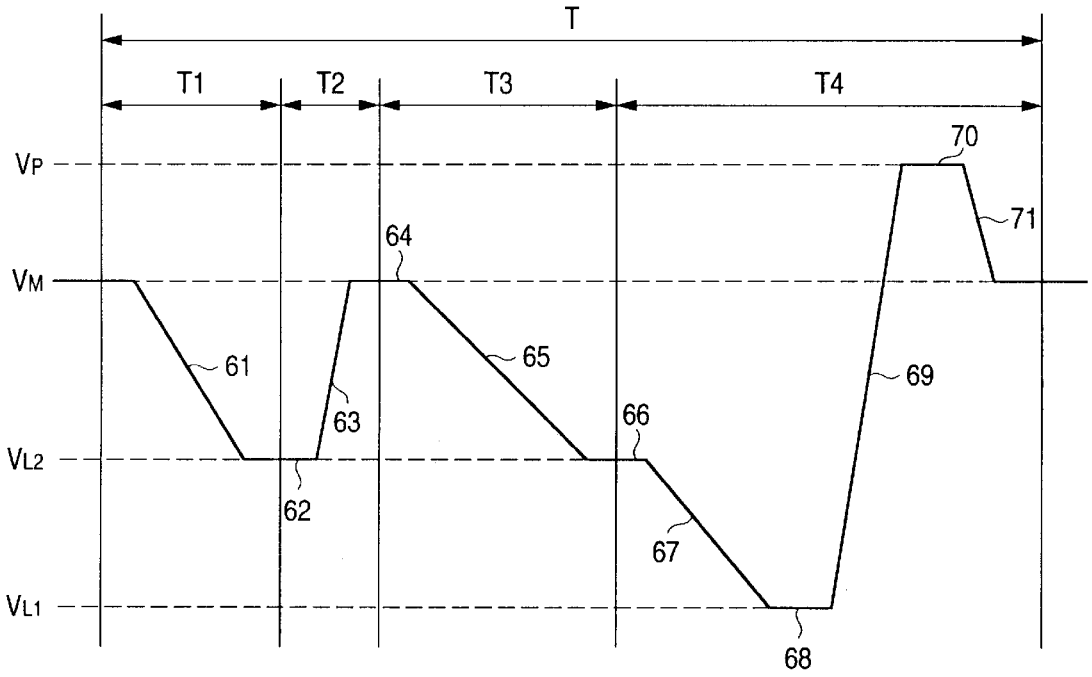
FIG. 10 (a)
FIG. 10 (b)
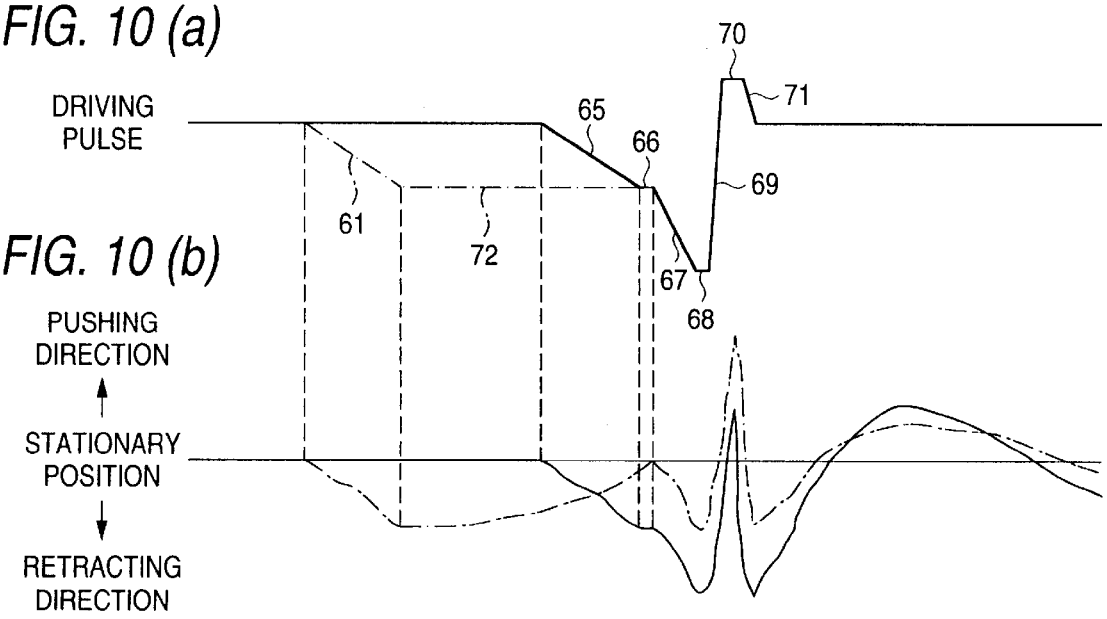

METHOD OF DRIVING AN INK JET RECORDING HEAD

BACKGROUND OF THE INVENTION

The present invention relates to a method of driving an ink jet recording head used for a recording apparatus, such as a printer and a plotter, and more particularly to an ink jet recording head capable of plural kinds of ink drops of different volumes through the same nozzle orifice.

In the ink jet recording head used for the printing device, a called "pull and shoot" control method is used in which a pressure generating chamber is expanded, and then is contracted to eject an ink drop through a nozzle orifice. In this control method controls an expansion of the pressure generating chamber to thereby control the volume of an ink drop to be ejected.

To eject a relatively large ink drop, the pressure generating chamber is controlled so that the meniscus (free surface) of ink in the nozzle orifice stays at a position near the front edge of the nozzle orifice, and then the pressure generating chamber is contracted. As a result, a large amount of ink is ejected through the nozzle orifice, to form an ink drop for forming a large dot.

To eject a relatively small ink drop, the pressure generating chamber is expanded so as to pull the meniscus toward the pressure generating chamber, and in this state, the pressure generating chamber is contracted. In this case, an ink drop of a small volume is ejected through the nozzle orifice. That is, the ink drop is for forming a small dot.

To perform a gradation print by use of ink drops of different volumes, small and large dots are printed on the same line on a recording medium or paper.

To print a pattern containing small dots X1 and large dots X2 as shown in FIG. 11(*a*), in a first scan (first path), the recording head is moved in the main scanning direction to print the small dots X1 (FIG. 11(*b*)). In a second scan (second path), the recording head is moved in the main scanning direction to print the large dots X2 (FIG. 11(*c*)).

Thus, a plurality of printing operations are repeated along one printing line. This is because a driving signal (driving pulse) for large dots and another driving signal for small dots are separately generated. The large-dot driving signal and the small-dot driving signal are separately generated, and those signals are selectively applied to the recording head every printing operation (printing path). Therefore, a plurality of the printing operations is repeated along one printing line inevitably.

As described above, the small dots Xl and the large dots X2 are printed on the same printing line. This results in reduction of the printing speed.

There is possibility that the scanning speeds for the printing operations of the small dots X1 and the large dots X2 lose their uniformity. If the scanning speeds lose their uniformity, the landing positions of the ink drops, viz., the landing center positions of the small and large dots X1 and X2, are deviated from the correct positions every size (diameter) of ink drop. The result is degradation of the print quality.

SUMMARY OF THE INVENTION

It is therefore an object of the present invention to provide a method of driving an ink jet recording head wherein the printing speed can be increased and the print quality can be improved.

In order to achieve the above object, there is provided a method of driving an ink jet recording head capable of ejecting plural kinds of ink drops having different volumes, comprising the steps of: generating a driving signal successively including: an expansion wave element for expanding a pressure generating chamber of the recording head, the expansion wave element composed of a first expanding element and a second expanding element which are successively arranged in order; an contraction wave element for contracting the pressure generating chamber expanded by the expansion wave element; generating selectively either a first driving pulse or a second driving pulse from the driving signal in accordance with the volume of the ink drop to be ejected, the first driving pulse including the first and second expanding elements and the contracting wave element, the second driving pulse including the second expanding element and the contracting wave element; and applying the either driving pulse to the pressure generating chamber in order to control the expansion and contraction thereof.

Accordingly, two expanding elements can be contained in the print period for forming one dot. The first and second driving pulses are selectively generated by properly selecting the expanding elements. Thus, two types of dots of different diameters can be printed on one print line by applying the first and second driving pulses. In other words, two types of dots can be printed through one printing operation (one main scanning), so that the printing speed is increased.

The two types of ink drops of different diameters may be ejected by use of the same contraction wave element. The result is to lessen a deviation of the landing center position of the ink drop irrespective of the size of the ink drop, and to improve the print quality.

In the method, the gradient of voltage variation of the first expanding element is smaller than those of the second expanding element and the contraction wave element.

Accordingly, the gradient of voltage variations of the second expansion wave element contained in both the first and second driving pulses serve as a major factor to determine a jetting velocity of an ink drop. Thus, a jetting velocity of an ink drop caused by the first drive pulse signal may be made to approach to that of an ink drop caused by the second drive pulse signal. Therefore, both the ink drops can be made to land at the correct landing center positions.

In the method, the expansion wave element further includes a connecting element for connecting the end point of the first expanding element and the start point of the second expanding element. A potential difference between the start point of the first expanding element and the connecting element defines a volume difference between the ink drops ejected by the first driving pulse and the second driving pulse.

Accordingly, the size difference between the different dots can be increased. As a result, the print quality cab be improved while the printing speed is increased.

In the method, a potential difference between the end point of the second expanding element and the contraction wave element defines driving voltage of the driving signal.

Accordingly, the driving voltage is determined based on the voltage for ejecting an ink drop for large dot. Therefore, the image quality for shadow area can be improved.

The method is applicable to an ink jet recording head in which a flexural vibration mode piezoelectric vibrator is used.

The method is applicable to an ink jet recording head in which a longitudinal vibration mode piezoelectric vibrator is used.

The method is applicable to an ink jet recording head of bubble-jet type.

BRIEF DESCRIPTION OF THE DRAWINGS

In the accompanying drawings:

FIGS. 2(*b*) and (*c*) is an enlarged view showing an orifice of the nozzle of the recording head;

FIG. 7(*b*) is a waveform diagram showing a variation of a position of a meniscus at the nozzle orifice, caused by the small-dot driving pulse;

FIG. 8(*b*) is a waveform diagram showing a variation of a position of a meniscus at the nozzle orifice, caused by the large-dot driving pulse;

FIG. 9 is a waveform diagram showing a waveform of a driving signal according to a second embodiment of the present invention;

FIG. 10(*a*) is a waveform diagram showing driving pulses;

FIG. 10(*b*) is a waveform diagram showing variations of positions of meniscuses each at the nozzle orifice, caused by the driving pulses;

FIG. 11(*b*) is a diagram showing how small dots are printed by the first printing path; and FIG. 11(*c*) is a diagram showing how large dots are printed by the second printing path.

DETAILED DESCRIPTION OF THE PREFERRED EMBODIMENTS

Figure 1:
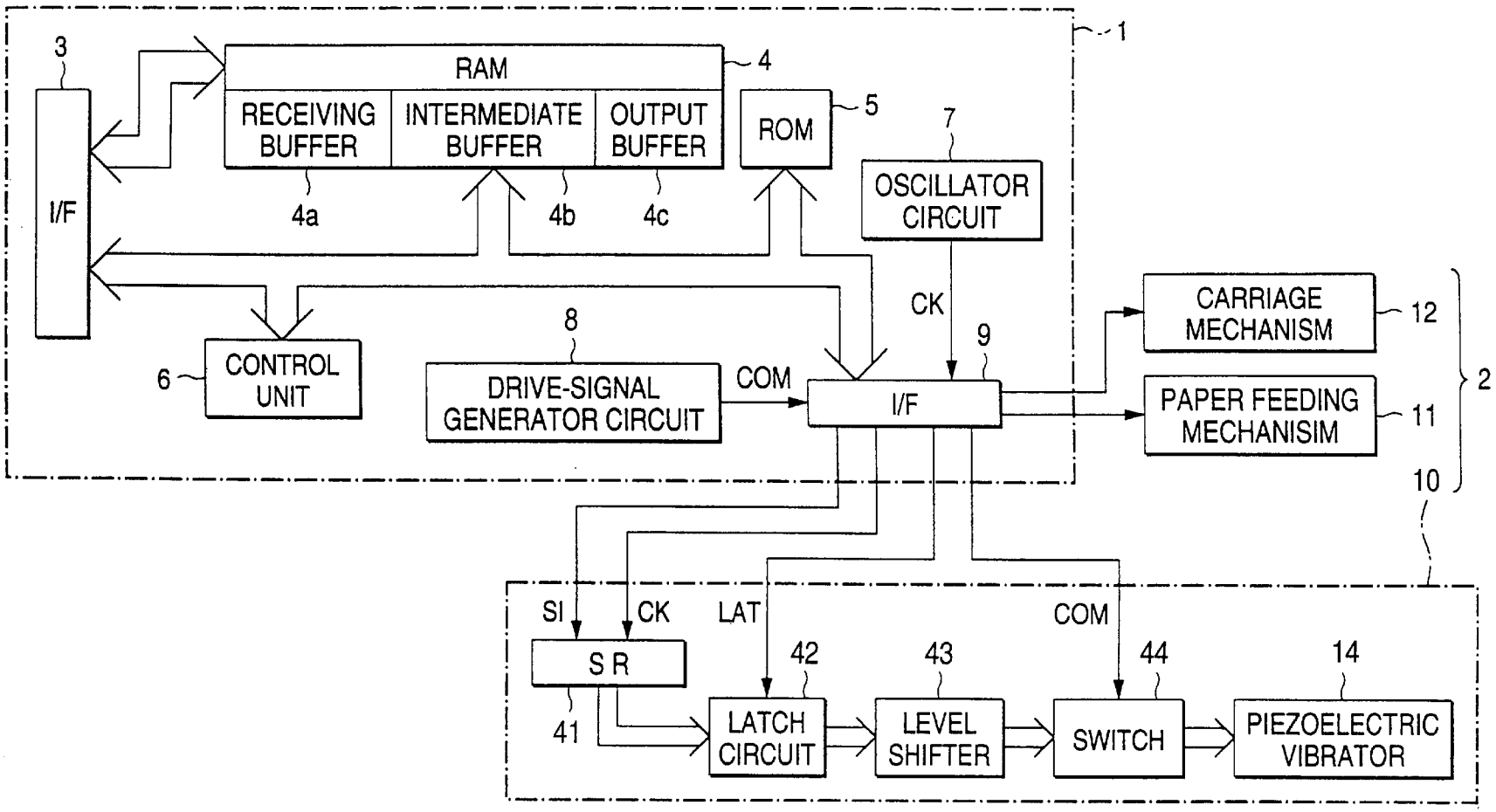
FIG. 1 is a block diagram showing an electrical configuration of an ink jet printer.

The preferred embodiments of the present invention will be described with reference to the accompanying drawings. As shown in FIG. 1, an ink jet printer illustrated comprises a print controller 1 and a print engine 2.

The print controller 1 comprises: an external interface (hereinafter, external I/F) 3; a RAM 4 for storing various data; a ROM 5 for storing control programs; a control unit 6 including a CPU; an oscillator circuit 7 for generating a clock signal; a driving signal generating circuit (as one form of driving signal generating means) 8 for generating a driving signal to apply a driving signal to the recording head; and an internal interface (hereinafter, internal I/F) 9 for sending dot pattern data (bit map data), which is developed in accordance with print data or the driving signal, to the print engine 2.

The external I/F 3 receives print data including at least character codes, graphic functions, image data from a host computer (not shown). A busy signal BUSY, an acknowledge signal ACK and the like are output to an external device, e.g., the host computer, through the external I/F 3.

The RAM 4 is used for a receiving buffer 4A, an intermediate buffer 4B, an output buffer 4C, and a work memory (not shown). The receiving buffer 4A temporarily stores print data coming in through the external I/F 3; the intermediate buffer 4B stores intermediate code data which is converted from the print data by the control unit 6; and the output buffer 4C stores dot pattern data. The dot pattern data consists of print data decoded (translated) from gradation data. As will be described later, the print data handled in the present embodiment is represented by a 2-bit signal.

The ROM 5 stores control programs (control routines) for various data processings, font data, graphic data, and others.

The control unit 6 reads out print data from the receiving buffer 4A, and loads intermediate code data, which is converted from the print data, into the intermediate buffer 4B. The control unit 6 analyzes the intermediate code data that is read out of the intermediate buffer 4B, and converts it into dot pattern data while referring to font data and graphic functions stored in the ROM 5. The control unit 6 appropriately modifies the dot pattern data and the resultant data into the output buffer 4C.

When the dot pattern data reaches in amount the data of one line of a recording head 10, the dot pattern data of one line is output from the output buffer 4C to the recording head 10, through the internal I/F 9. When the dot pattern data of one line is output, the developed intermediate code data is deleted from the intermediate buffer 4B, and then the next intermediate code data is developed into the intermediate buffer.

The print engine 2 includes the recording head 10, a paper feeding mechanism 11 and a carriage mechanism 12.

The paper feeding mechanism 11 includes a paper feed motor and paper feed rollers, and feeds forwards a recording medium, e.g., a recording paper, synchronously with the printing operation of the recording head 10. That is, the paper feeding mechanism 11 moves the recording medium in the paper feeding direction, i.e., the subscanning direction.

The carriage mechanism 12 includes a carriage for carrying the recording head 10 thereon, and a carriage driver for moving the carriage in the main scanning direction. The carriage mechanism 12 drives the carriage and moves the recording head 10 mounted thereon in the main scanning direction. The carriage mechanism may be any mechanism if it is capable of moving the carriage, such as a mechanism using a timing belt.

The recording head 10 has a number (for example, 48) of nozzle orifices 13 (see FIG. 2) arrayed in the subscanning direction. Different sizes of ink drops of may be ejected through one nozzle orifice 13. In the embodiment, the recording head is capable of ejecting two types of ink drops, one for forming a "large dot" and the other for a "small dot". The recording head 10 ejects ink drops through the nozzle orifices 13 while being timed in accordance with dot pattern data.

The details of the recording head 10 will be given. A mechanical configuration of the recording head 10 will first be described with reference to FIG. 2(*a*). In the description to follow, the electromechanical transducing elements of the recording head 10 are piezoelectric vibrators 14 of the flexural vibration type. The piezoelectric vibrator 14 functions as follows: when charged, the piezoelectric vibrator 14 contracts and deforms a pressure generating chamber 15

(more detail, such portion in the piezoelectric vibrator 14 defining the pressure generating chamber 15) to reduce volume thereof, and when discharged, the piezoelectric vibrator expands to deform the pressure generating chamber 15 to increase volume thereof. In the description of the structure of the recording head 10, the lower side in this figure is defined as front side, and the upper side is defined as rear side.

Figure 2:
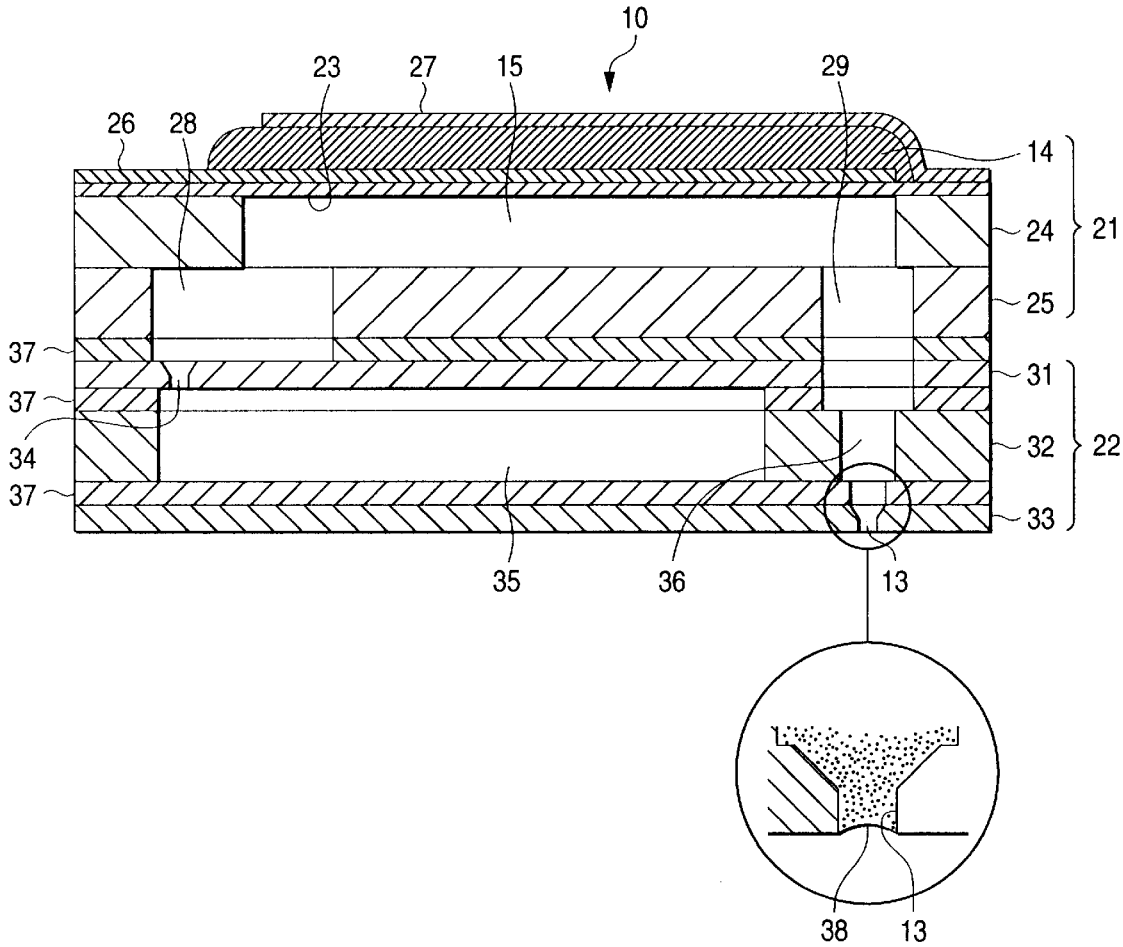
FIG. 2(*a*) is sectional view showing a structure of a recording head.
Figure 2:
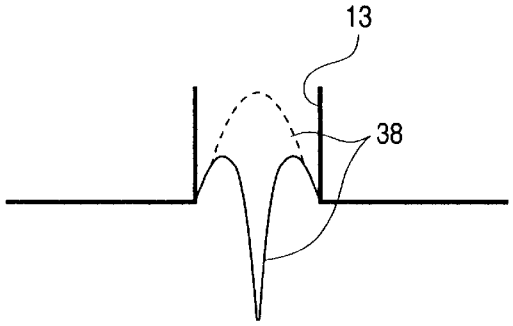
Figure 2:
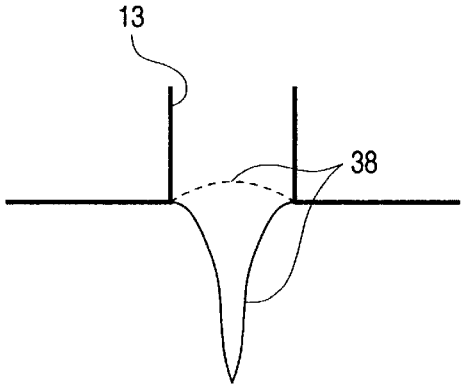

As shown in FIG. 2(*a*), the recording head 10 comprises an actuator unit 21 and a passage unit 22.

The actuator unit 21 will be described. The actuator unit 21 is formed with at least a first cover member 23, a spacer member 24, a second cover member 25, and a piezoelectric vibrator 14.

The first cover member 23 consists of a flexible thin plate made of ceramic (zirconia (ZrO2) in this embodiment), thickness of which is about 6 $\mu$m. A common electrode 26 as one of the electrodes of the piezoelectric vibrator 14 is formed on the rear surface of the first cover member 23. The piezoelectric vibrator 14 is firmly layered on the common electrode 26. A drive electrode 27 as the other electrode of the piezoelectric vibrator 14 is formed on the rear surface of the piezoelectric vibrator 14, which is opposite to the surface on which the common electrode 26 is formed. Those electrodes, the common electrode 26 and the drive electrode 27 are made of relatively soft conductive layers of gold (Au), for example.

The spacer member 24 is made of a ceramic plate having a thickness enough to form pressure generating chambers 15 therein. In this embodiment, it is a zirconia plate of about 100 $\mu$m thick and a number of pressure generating chambers 15 are formed therethrough.

The second cover member 25 consists of a ceramic member (a ceramic plate of zirconia in the embodiment) structured as shown in FIG. 2(*a*). In the left side of the figure, the second cover member 25 includes through holes serving as ink-supply passages 28 respectively communicating an ink supply port 34 and an associated pressure generating chamber 15. In the right side of the figure, the second cover member 25 includes through holes respectively communicating a pressure generating chamber 15 and an associated nozzle orifice 13. The first cover member 23 is disposed on the rear surface of the spacer member 24, while the second cover member 25 is disposed on the front surface of the spacer member 24. The spacer member 24 is thus sandwiched between the first cover member 23 and the spacer member 24 to constitute the actuator unit 21.

In the thus structured actuator unit 21, the rear side of the pressure generating chamber 15 is defined by the first cover member 23, while the front side thereof is defined by the second cover member 25. The ink-supply passage 28 and the first nozzle passage 29 are opened into the associated pressure generating chamber 15. To form the first cover member 23, the second cover member 25 and the spacer member 24, clay-like ceramic is formed into predetermined plate-like shapes, those plate-like members are then layered on one on another and baked. They are integrated with each other without using any adhesive.

The passage unit 22 will be described. The passage unit 22 is formed with at least a port substrate 31, a reservoir substrate 32 and a nozzle plate 33.

The port substrate 31 is a plate-like member in which through holes serving as the ink supply ports 34 are formed in the left side of the figure, while through holes serving as the first nozzle passages 29 are formed in the right side of the figure. The port substrate 31 also serves as a substrate for fixing the actuator unit 21.

The reservoir substrate 32 is a plate-like member including a through hole serving as an ink reservoir 35 and another through holes serving as second nozzle passages 36, formed in the right side of the figure. Each of the second nozzle passage 36 is smaller in diameter than the first nozzle passage 29, but is larger in diameter than the rear end of the nozzle orifice 13.

The nozzle plate 33 is a plate-like member, for example, a stainless steel plate, having a number (for example, 48) of nozzle orifices 13 arrayed on that portion in the right side of the figure. Those nozzle orifices 13 are linearly arrayed in the subscanning direction at pitches corresponding to a dot density.

The nozzle plate 33 is disposed on the front surface of the reservoir substrate 32, while the port substrate 31 is disposed on the rear side thereof. An adhesive layer 37 is inserted between the reservoir substrate 32 and the nozzle plate 33, and another adhesive layer 37 is inserted between the reservoir substrate 32 and the port substrate 31. Those members, the port substrate 31, the reservoir substrate 32 and the nozzle plate 33, are integrally combined into one unit, viz., the passage unit 22. The adhesive layers 37 may be a heat-welding film, adhesive or other suitable bonding means.

In the thus structured passage unit 22, the ink reservoir 35 is defined by the port substrate 31 and the nozzle plate 33. The ink reservoir 35 is communicated to the ink supply port 34 and further to an ink-supply passage (not shown). The ink-supply passage is provided for supplying ink stored in an ink cartridge to the ink reservoir 35.

The respective nozzle orifices 13 communicate with the associated first nozzle passages 29 through the associated second through hole 36 at that portion of the passage unit 22 in the right side of the figure.

The passage unit 22 and the actuator unit 21 are bonded together by a heat welding film or an adhesive layer 37, into a single unit, or a recording head 10.

In the recording head 10, the ink reservoir 35 of the passage unit 22 communicates with the ink-supply passages 28 of the actuator unit 21 through the associated ink supply ports 34. The through holes formed at that portion of the port substrate 31 in the right side of the figure, are communicatively coupled to the associated through holes formed at that portion of the port substrate 31 in the right side of the figure, to thereby form the first nozzle passages 29. Resultantly, ink passages extending from the ink reservoir 35 to the respective nozzle orifices 13 via the associated pressure generating chambers 15 are formed. When the volume of the pressure generating chamber 15 is varied, an ink drop is ejected through the nozzle orifice 13.

To brief, when the piezoelectric vibrator 14 is charged, the piezoelectric vibrator 14 contracts, the first cover member 23 deforms, and the volume of the pressure generating chamber 15 reduces, viz., the pressure generating chamber 15 contracts. When the charged piezoelectric vibrator 14 is discharged, the piezoelectric vibrator 14 expands; the first cover member 23 deforms so as to resume its original volume; and the pressure generating chamber 15 expands. Therefore, if the piezoelectric vibrator 14 is driven so as to expand the pressure generating chamber 15 and then to contract the same, an ink pressure within the pressure generating chamber 15 increases to eject an ink drop through the nozzle orifice 13.

Further, the volume of an ejected ink drop, i.e., the diameter of a dot formed, can be varied by controlling an expansion of the pressure generating chamber 15. In other words, the volume of the ink drop can be varied by a quantity of pull-in movement of a meniscus 38 in the ink in the nozzle orifice 13. The meniscus is a free surface of the ink drop at the orifice 13 of the nozzle, as enlargedly illustrated in FIG. 2(*a*).

When, as shown in FIG. 2(*b*), the pressure generating chamber 15 is expanded to greatly retract or pull the meniscus 38 toward the pressure generating chamber 15, and the pressure generating chamber 15 is contracted in this state of the meniscus being pulled, an amount of ink ejected outside through the nozzle orifice 13 is relatively small. In this case, an ink drop of an extremely small volume, which is suitable for forming a "small dot", is ejected. When, as shown in FIG. 2(*c*), the pressure generating chamber 15 is contracted in a state that the meniscus 38 is positioned at the front edge (the circumferential edge of the orifice 13) of the nozzle, an amount of ink ejected forward from the nozzle orifice 13 is large. This amount or volume of the ink drop is substantially capable of ejecting an ink drop to form a "large dot".

Figure 3:
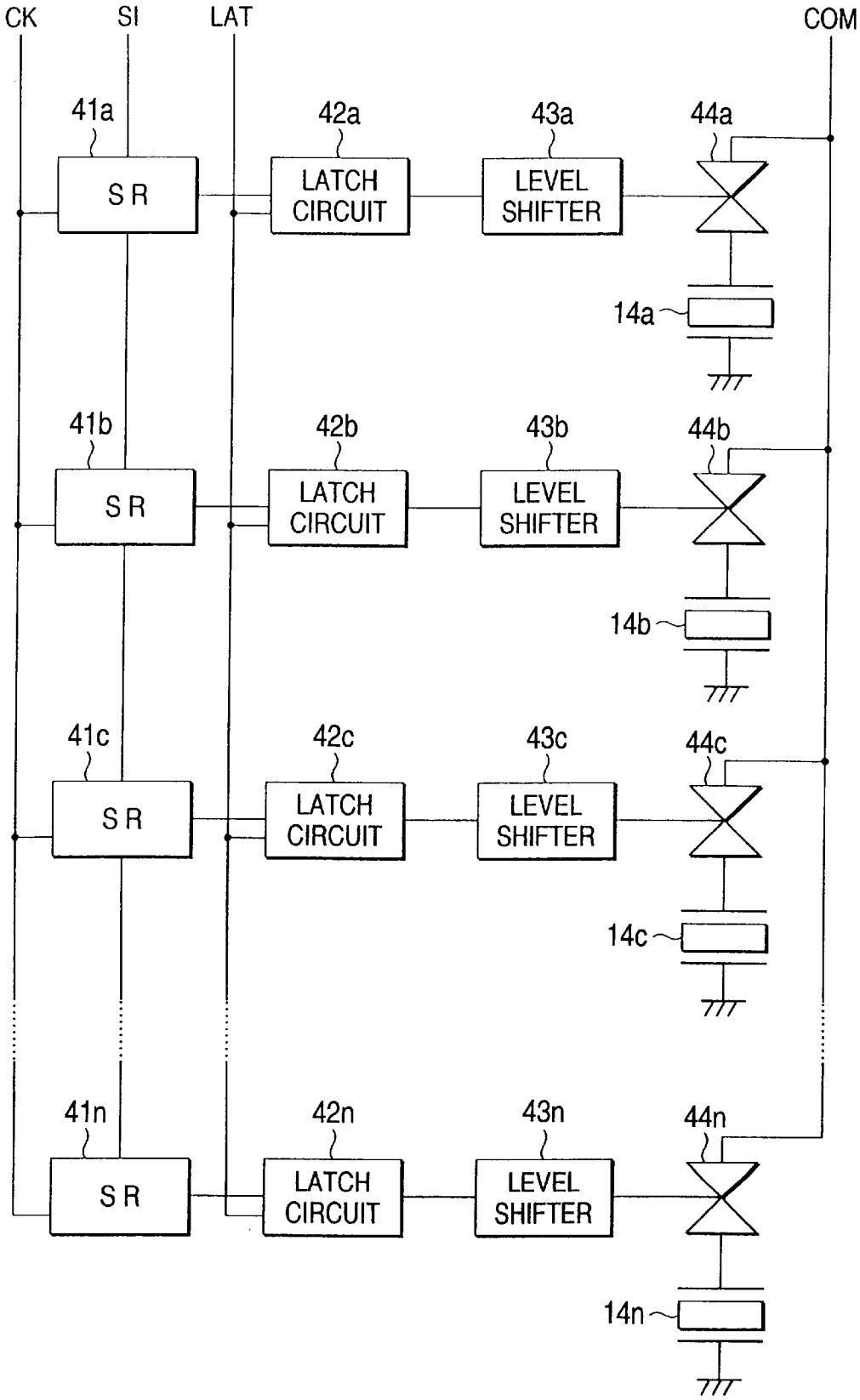
FIG. 3 is a block diagram showing the detail of driving-pulse generating section in the recording head.

An electrical construction of the recording head 10 will be described. The recording head 10, as shown in FIG. 1, includes at least a shift register 41, a latch circuit 42, a level shifter 43, a switching circuit 44 and a piezoelectric vibrator 14. As shown in FIG. 3, the shift register 41 consists of shift register elements 41A to 41N, which are provided in association with the nozzle orifices 13 of the recording head 10; similarly, the latch circuit 42 consists of latch elements 42A to 42N; the level shifter 43 consists of level shifter elements 43A to 43N; the switching circuit 44 consists of switching elements 44A to 44N; and the piezoelectric vibrator 14 consists of piezoelectric vibrator elements 14A to 14N. Signals flow through the circuit arrangement of the recording head 10 in the order of the shift register 41, the latch circuit 42, the level shifter 43, the switching circuit 44 and the piezoelectric vibrator 14.

The shift register 41, the latch circuit 42, the level shifter 43, and the switching circuit 44, when combined, form a driving pulse generating section. The driving pulse generating section generates a driving pulse from a driving signal generated by the driving signal generating circuit 8. Here, the "driving pulse" means a pulse signal actually applied to the piezoelectric vibrator 14, and the "driving signal" is a signal constituted by successive pulse signals (original driving pulses), which are to be composed to generate the driving pulse.

It will be appreciated that the invention is applicable to other technologies besides flexural piezoelectric technology, such as vertical actuator technology and bubble jet technology, to name a few. For the sake of generality, therefore, it will be understood that the driving pulse generating section may be referred to as a means for driving a change in a present chamber volume of a chamber of a recording head. The output from the driving pulse generating section may also be referred to as a chamber driving signal.

In order to conduct a recording, in the recording head 10 thus electrically arranged, the control unit 6 causes the output buffer 4C to serially send out the most significant bit data of the print data SI of the dot pattern data to the shift register 41; the MSB data is loaded into the shift register elements 41A to 41N.

When the print data for all the nozzle orifices 13 have been loaded into the shift register elements 41A to 41N, the control unit 6 sends a latch signal LAT to the latch circuit 42 at a proper time point. In response to the latch signal LAT, the latch circuit 42 (the latch elements 42A to 42N) latches the print data, which receives from the shift register 41 (the shift register elements 41A to 41N). The print data is supplied from the latch circuit 42 to the level shifter 43 (the level shifter elements 43A to 43N) serving as a voltage amplifier. When the print data is "1", for example, the level shifter 43 amplifies the print data signal up to a signal (voltage) level (for example, several tens V), which is high enough to drive the switching circuit 44 (the switching elements 44A to 44N). The print data signal thus level-shifted is applied to the switching circuit 44 (the switching elements 44A to 44N), so that the switch is turned on.

At this time, a driving signal COM has been applied to the switching elements 44A to 44N, from the driving signal generating circuit 8. The switching elements 44A to 44N, when turned on, allow the driving signal to go to the piezoelectric vibrator elements 14A to 14N, which are coupled for reception with the switching elements 44A to 44N, respectively.

After applying the driving signal to the piezoelectric vibrator in response to the MSB data, the control unit 6 serially transfers data of the next one of the MSB to the shift register elements 41A to 41N. In response to a latch signal LAT, the latch circuit latches the data from the shift register therein and then transfers the data to the piezoelectric vibrator 14 (the piezoelectric vibrator elements 14A to 14N). Subsequently, the above sequence of operations, while shifting the print data bit by bit, is repeated and continued up to the least significant bit.

Thus, in the recording head 10, it is able to control whether the driving signal is applied to the piezoelectric vibrator 14 in accordance with the print data. During a period that the print data is "1", the switching circuit 44 is turned on to allow the driving signal to go to the piezoelectric vibrator 14, and the driving signal deforms the piezoelectric vibrator 14. During a period that the print data is "0", the switching circuit 44 is turned off to prohibit the driving signal from going to the piezoelectric vibrator 14. During this period, the piezoelectric vibrator 14 holds the amount of charge (potential) at the preceding period, and hence the preceding deformation state of the vibrator is retained.

As the driving signal is composed of a plurality of pulses, plural kinds of driving signals can be generated by selecting "1" or "0" of the print data set for every pulse.

A control of the recording head 10 will be described. In the description to follow, three gradation levels, "large dot", "small dot" and "non-print", are used for ease of explanation. The "large dot" is a large dot formed by using a large ink drop of which the ink volume is about 20 pl. The "small dot" is a relatively small dot formed by using a small ink drop of which the ink volume is about 5 pl. In the "non-print", no ink drop is ejected, but the meniscus 38 is somewhat moved to agitate ink in the vicinity of the nozzle orifice 13 to prevent an viscosity of ink thereat from increasing.

Figures 4, 5:
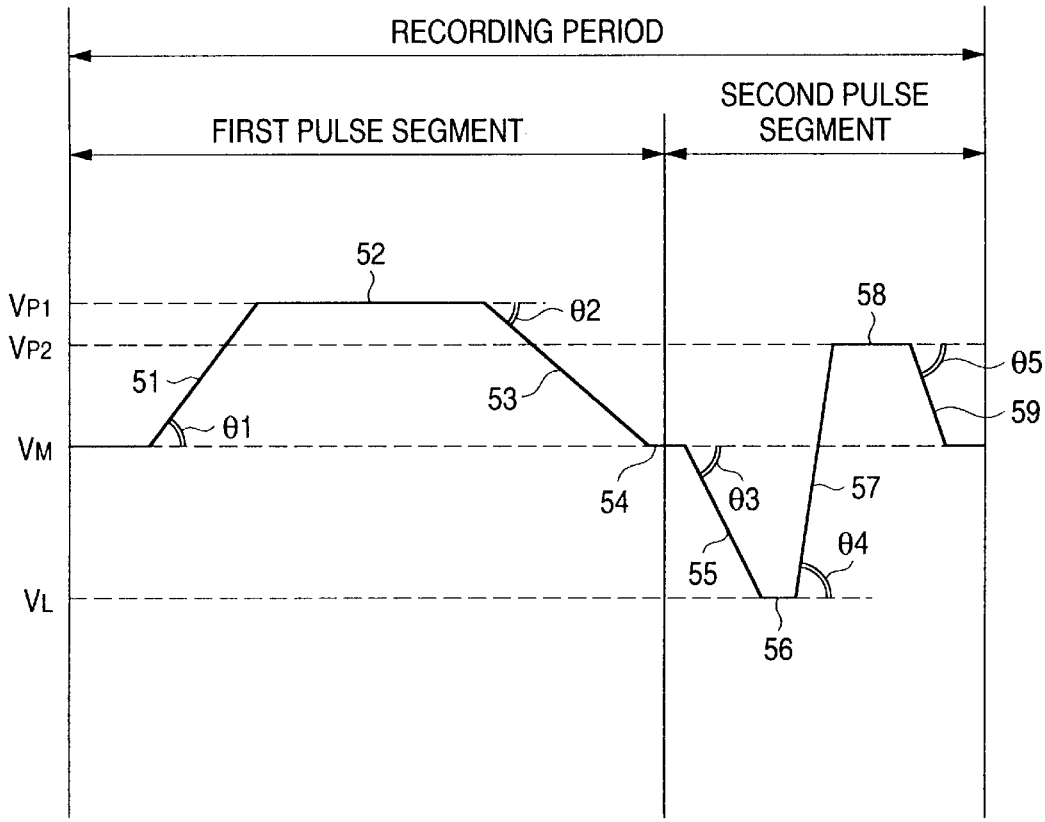
FIG. 4 is a waveform diagram showing a waveform of a driving signal according to a first embodiment of the present invention.
FIG. 5 is a table showing how to generate driving pulses.

A driving signal generated by the driving signal generating circuit 8 is capable of ejecting two different ink drops for forming large and small dots through the nozzle orifice 13. A specific example of the driving signal is illustrated in FIG. 4. As shown, it consists of two pulse segments (referred to as first and second pulse segments). Different print data are respectively assigned to the first and second pulse segments so as to select whether the driving pulses is applied to the recording head 10. The driving signal generating circuit 8 generates the driving signal at predetermined period corresponding to a time taken for one dot to be recorded.

The driving signal will be described in detail. The illustrated driving signal contains a succession of a first contraction element 51, a first holding element 52, a first expansion element 53, a connection element 54, a second expansion element 55, a second holding element 56, a second contraction element (discharging element) 57, a third holding element 58, and a damp element 59.

The first contraction element 51, the first holding element 52 and the first expansion element 53 compose the first pulse segment. The second expansion element 55, the second holding element 56, the second contraction wave element (discharging element) 57, the third holding element 58 and the damp element 59 compose the second pulse segment. The first half of the connection element 54 composes a part of the first pulse segment, and the second half thereof composes a part of the second pulse segment.

The first expansion element 53, the connection element 54 and the second expansion element 55 constitute an expansion wave element of the present invention; the first expansion element 53 constitutes a first expanding element of the present invention; the second expansion element 55 constitutes a second expanding element; the connection element 54 constitutes a connecting element; and the second contraction element 57 constitutes a contracting wave element.

In the first contraction element 51, the signal voltage increases from a medium voltage VM to a first upper peak voltage VP1 at a predetermined gradient θ1. The first contraction element 51, when applied to the piezoelectric vibrator 14, charges the piezoelectric vibrator and in turn the pressure generating chamber 15 contracts. The θ1 defining an ascending slope of the first contraction element 51 is selected so as not to eject an ink drop. In the first holding element 52, the first upper peak voltage VP1 is held for a predetermined time. A contraction state of the pressure generating chamber 15 is maintained with provision of the first holding element 52.

In the first expansion element 53, the signal voltage decreases from the first upper peak voltage VP1 to the medium voltage VM at a predetermined gradient θ2. The first expansion element 53, when applied to the piezoelectric vibrator 14, discharges the piezoelectric vibrator and the contracted pressure generating chamber 15 gradually expands. The connection element 54, set at the medium voltage VM, interconnects the end point of the first expansion element 53 and the start point of the second expansion element 55. The connection element 54 is provided for securing a time for setting print data D2 (to be described later) of the second pulse segment. In the second expansion element 55, the signal voltage decreases from the medium voltage VM to a lower peak voltage VL at a predetermined gradient θ3. The second expansion element 55, when applied to the piezoelectric vibrator 14, further discharges the piezoelectric vibrator, and the pressure generating chamber 15 expands.

The second holding element 56, set at the lower peak voltage VL, interconnects the end point of the second expansion element 55 and the start point of the second contraction element 57. The second holding element 56 provides a timing to contract the pressure generating chamber 15 expanded by the second expansion element 55. In the second contraction element 57, the signal voltage increases from the lower peak voltage VL to a second upper peak voltage VP2 at a predetermined gradient θ4. The second upper peak voltage VP2 is slightly lower than the first upper peak voltage VP1. The second contraction element 57, when applied to the piezoelectric vibrator 14, rapidly contracts the pressure generating chamber 15, an ink pressure within the pressure generating chamber 15 rapidly increases and thereby an ink drop is ejected from the nozzle orifice 13. In this sense, the second contraction element 57 partly constitutes the discharging element.

In the third holding element 58, the second upper peak voltage VP2 is held for a predetermined time. And it partly constitutes the discharging element. A contraction state of the pressure generating chamber 15 is maintained with the provision of the third holding element 58. In the damp element 59, the signal voltage decreases from the second upper peak voltage VP2 to the medium voltage VM at a predetermined gradient θ5.

The voltage of the driving signal is designed with reference to a difference between the lower peak voltage VL and the second upper peak voltage VP2, viz., a voltage value or level capable of causing an ink drop for forming the large dot. Use of the voltage level for the large dot for the reference voltage improves a print quality of shadow image.

Figure 6:
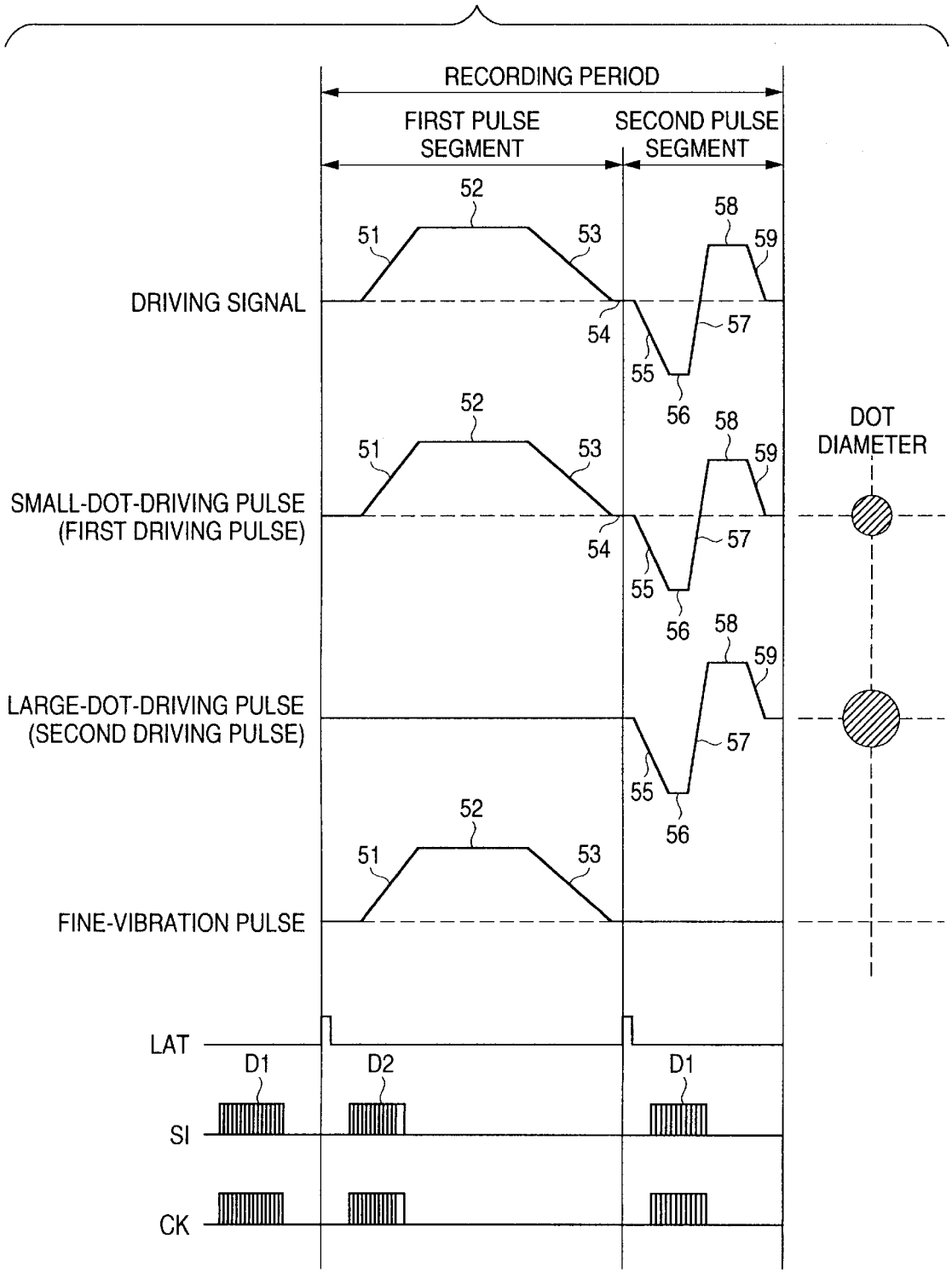
FIG. 6 is a waveform diagram showing a relationship between the driving signal and the driving pulses generated from the driving signal.

The driving pulse generating section (shift register 41, latch circuit 42, level shifter 43, and switching circuit 44), as seen from FIGS. 5 and 6, selects the first and second pulse segments in accordance with the print data, and generates a small driving pulse for ejecting an ink drop for forming the small dot from the driving signal; selects the second pulse segment to generate a large driving pulse for ejecting an ink drop for forming the large dot; and selects the first pulse segment to generate a fine-vibration pulse (a kind of driving pulse) for agitating ink in the vicinity of the nozzle orifice 13.

Two print data D1 and D2 each consisting of 2 bits are used in the embodiment. The print data D1 is used for selecting the first pulse segment and the print data D2 is used for selecting the second pulse segment. (Signals representative of the print data D1 and D2 will be called first and second select signals D1 and D2.) The gradation data 1 (gradation value: 00) is decoded (translated) into print data of "10"; the gradation data 2 (value: 11) is decoded into print data of "11"; and the gradation data 3 (value: 10) is decoded into print data of "01".

It is assumed that the number of the nozzle orifices 13 of the recording head 10 is n, and that data applied to the first nozzle orifice 13 is (D11, D21); data applied to the second nozzle orifice 13 is (D12, D22); . . . ; data applied to the n-th nozzle orifice 13 is (D1n, D2n). The print data is applied to the piezoelectric vibrator 14 in the following way.

A first select signal D1, which is representative of the print data D1 (D11, D12, D13, . . . , D1n) for selecting the pulse segment, are serially transferred to the shift register elements 41A to 41N synchronously with a clock signal CK. After completion of the transfer of the print data D1 for all the nozzle orifices to the shift register 41 (41A to 41N), the print data D1 is latched in the latch circuit 42 in response to a latch signal LAT, and then the data is transferred to the switching elements 44A to 44N of the switching circuit 44.

After the print data D1 is latched, a second select signal D2, which is representative of the print data D2 (D21, D22, D23, . . . , D2n) for selecting the second pulse segment, are serially transferred to the shift register elements 41A to 41N synchronously with a clock signal CK, the print data D2 is latched in the latch circuit 42 in response to a latch signal LAT, and then the data is transferred to the switching element 44A to 44N at beginning of the second pulse segment, viz., at a time point of applying the connection element 54 of the driving signal. In the present embodiment, the time length of the connection element 54 corresponds to a latching time of the print data D2. In other words, the connection element 54 lasts for a time required for latching the print data D2.

After the print data D2 is latched, the print data D1 (D11, D12, D13, . . . , D1n) for the next dot is serially transferred into the shift register elements 41A to 41N, and a similar operation will be performed.

In this way, the large-dot driving pulse, the small-dot driving pulse and the fine-vibration pulse can be generated by transferring the print data D1 and D2 into the driving pulse generating section. The details of those driving pulses will be described.

Figure 7:
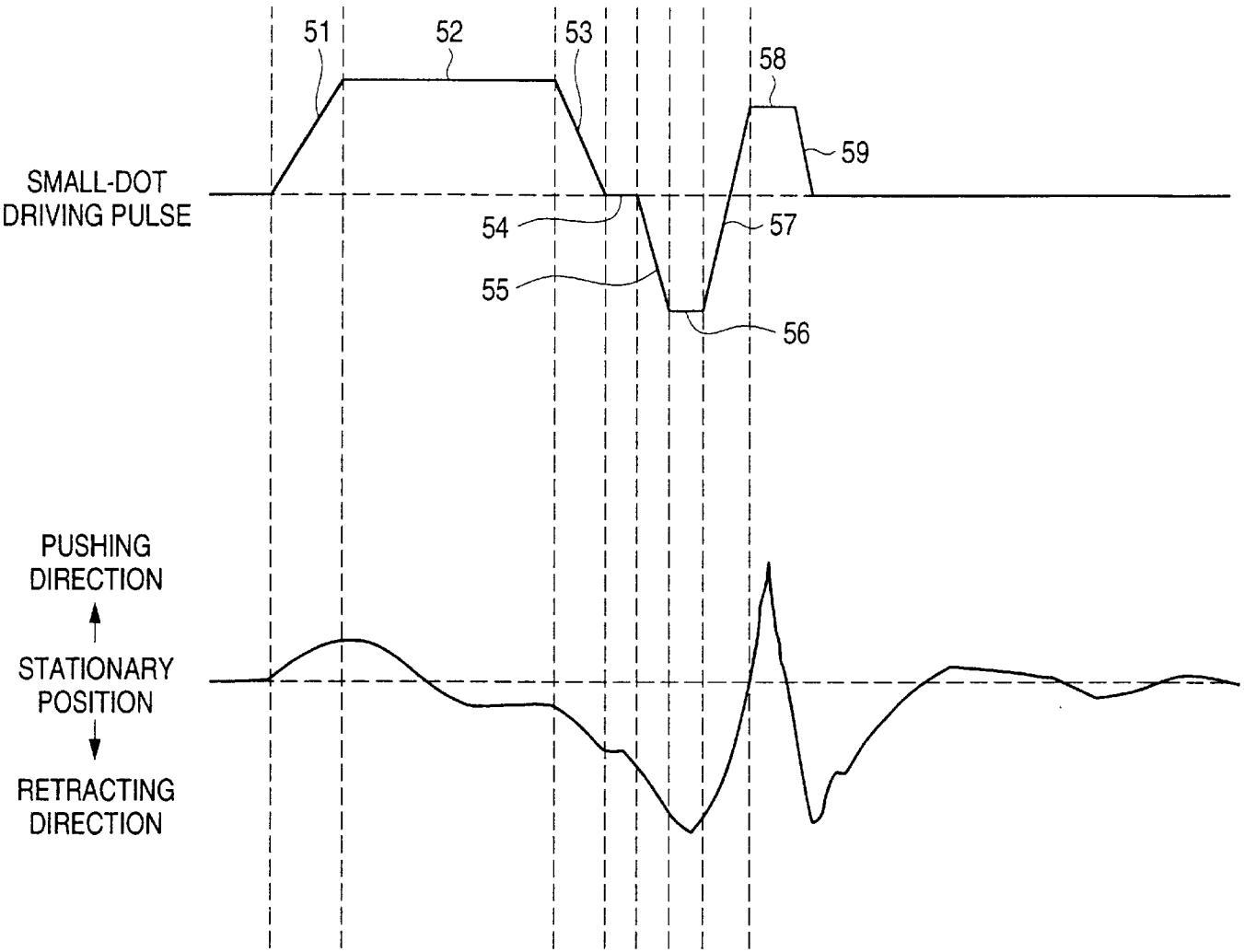
FIG. 7(*a*) is a diagram showing a waveform of a small-dot driving pulse.

The small-dot driving pulse (first driving pulse in the present invention) will first be described. This pulse signal is used for ejecting a small ink drop for forming the small dot. The small-dot driving pulse, which is generated by selecting both of the first and second pulse segments (FIG. 5). The waveform of the large-dot driving pulse is configured as shown in FIG. 7(*a*). A position at which the meniscus 38 is present varies in a pushing direction (toward the front side) and a retracting or pull-in direction (toward the rear side) in accordance with waveform of the small-dot driving pulse with respect to a stationary position. The position of the meniscus 38 shown in FIG. 7(*b*) is the center position in the nozzle orifice 13 when viewed in plan.

The first contraction element 51 of the small-dot driving pulse first reaches the piezoelectric vibrator; in turn, the pressure generating chamber 15 contracts; the meniscus 38 gradually moves from the stationary position (corresponding to the medium voltage VM) in the pushing direction. Then, the first holding element 52 reaches the piezoelectric vibrator, and in this case, a contraction state of the pressure generating chamber 15 is maintained. In this state, the direction of a pressure wave of ink within the pressure generating chamber 15 is inverted to move the meniscus 38 in the retracting direction. At instant that the retracting meniscus 38 moves beyond the stationary position, the first expansion element 53 (first expanding element of the present invention) reaches the piezoelectric vibrator, and it further moves the meniscus 38 in the retracting direction. The connection element 54 and then second expansion element 55 (second expanding element of the present invention) reach the piezoelectric vibrator, so that the meniscus 38 further retracts.

In the embodiment, the length of the connection element 54 is substantially equal to the latching time duration of the print data D2, viz., a switching time from the print data D1 for the first pulse segment to the print data D2 for the second pulse segment. In this respect, the time length of the connection element 54 is minimized. Therefore, time loss caused by the switching from the first expansion element 53 to the second expansion element 55 can be minimized. For this reason, the meniscus 38 may be pulled in or retracted continuously and efficiently.

The retracting state of the meniscus is held for a predetermined time. Therefore, the meniscus recoils, the direction of a pressure wave of ink within the pressure generating chamber 15 is inverted, and the meniscus 38 begins to move in the pushing direction. At this time, the second contraction element 57 (discharging element) reaches the piezoelectric vibrator, so that the volume of the pressure generating chamber 15 abruptly contracts. With the abrupt contraction, an ink pressure within the pressure generating chamber 15 increases, while at the same time the meniscus 38 moves in the pushing direction at relatively high speed. Then, the third holding element 58 reaches the piezoelectric vibrator, so that a contraction state of the pressure generating chamber 15 is maintained for a predetermined time. In this state, the meniscus 38 moves beyond the front edge of the nozzle orifice 13, and inverts its moving direction by its recoiling. At this time, part of ink is separated from the meniscus and ejected in the form of an ink drop toward the recording medium.

The amount of the ejected ink drop is small, but is capable of forming a small dot. This is because a quantity of projection of the meniscus 38 from the front edge of the nozzle orifice 13 is small since the meniscus 38 is continuously retracted by the first expansion element 53 and the second expansion element 55 (FIG. 2(*b*)).

The damp element 59 reaches the piezoelectric vibrator during the retracting movement of the meniscus 38. The damp element 59 expands the pressure generating chamber 15, to impede the retracting movement of the meniscus 38. In other words, the ink pressure wave within the pressure generating chamber 15 is weakened by the expansion. Therefore, the fluctuation of the meniscus 38 in the front and rear directions is damped.

Figure 8:
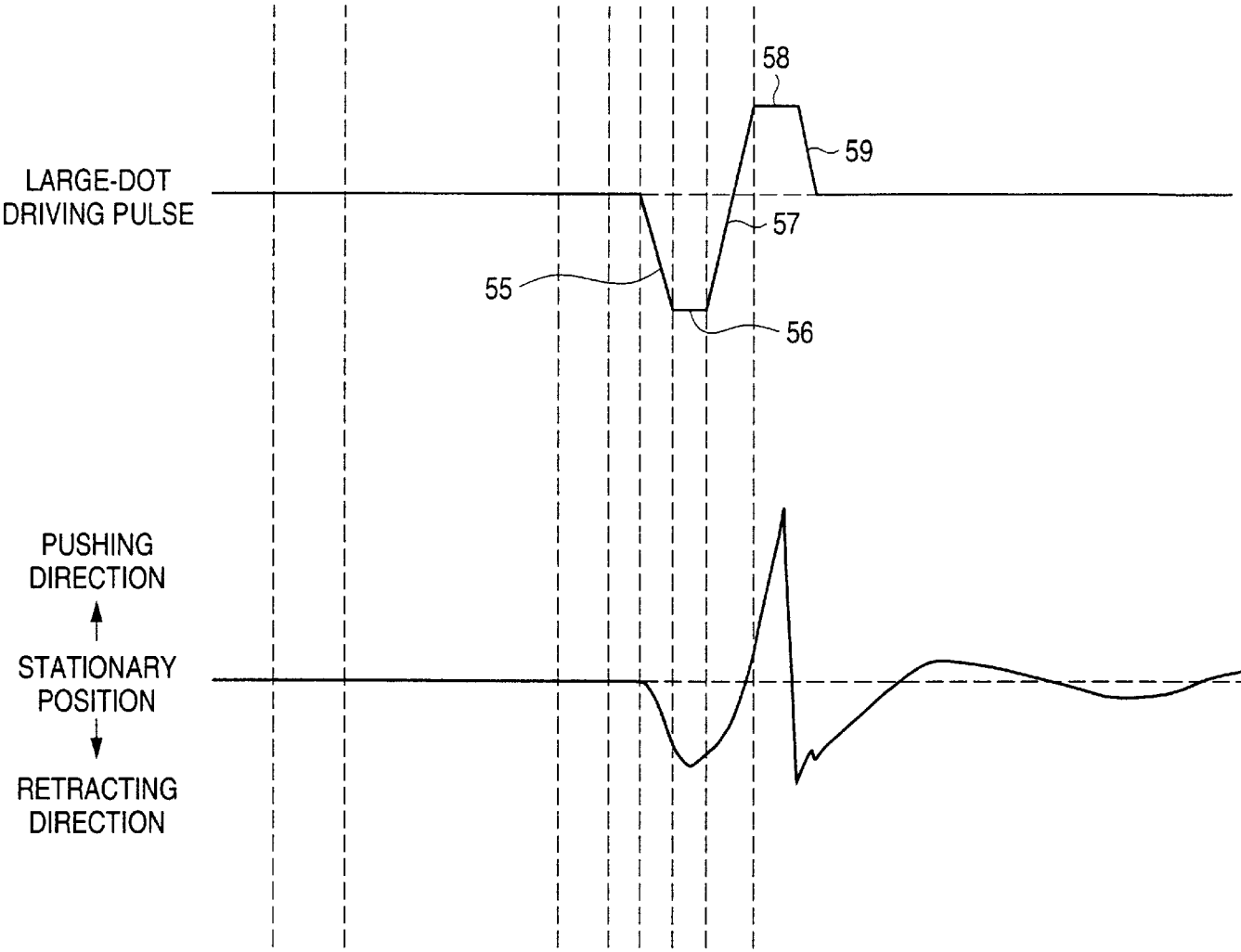
FIG. 8(*a*) is a diagram showing a waveform of a large-dot driving pulse.
Figure 11:
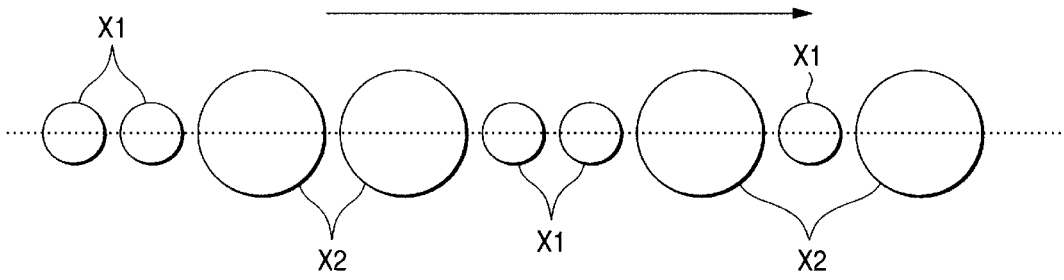
FIG. 11(*a*) is a diagram showing dots printed on one printing line.
Figure 11:
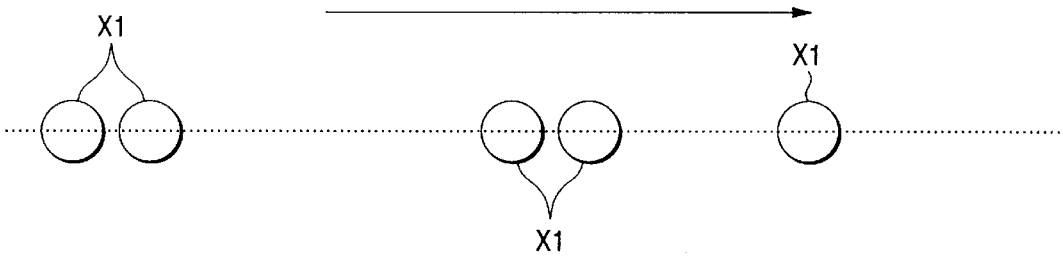
Figure 11:
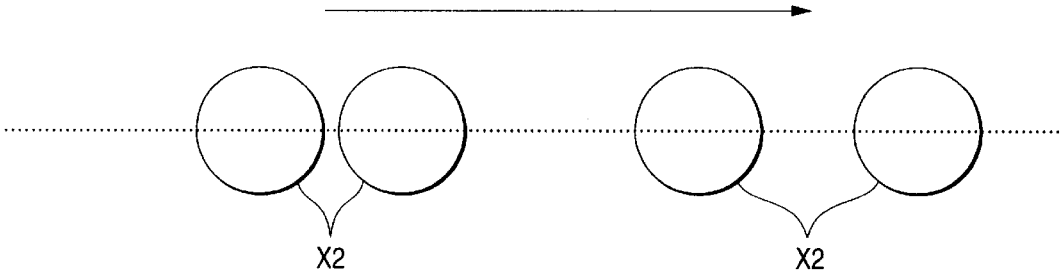

Next, the large-dot driving pulse (second driving pulse of the present invention) will be described. This signal is used for ejecting an ink drop for forming a large drop. The waveform of the large-dot driving pulse is configured as shown in FIG. 8(*a*). The large-dot driving pulse is generated by selecting the second pulse segment as shown in FIG. 5. When the large-dot driving pulse is applied to the piezoelectric vibrator, a position of the meniscus 38 varies in the pushing direction and the retracting direction with respect to the stationary position.

The second expansion element 55 (second expanding element of the present invention) of the large-dot driving pulse first reaches at the piezoelectric vibrator. In turn, the meniscus 38 slightly retracts from the stationary position, and is positioned at a point closer to the front side, or the edge of the nozzle orifice 13, than the point at which the meniscus 38 is positioned when it is retracted by the second expansion element 55 of the small-dot driving pulse. The reason for this is that the meniscus 38 is retracted from the stationary position by use of only the second expansion element 55.

The second holding element 56 of the large-dot driving pulse then reaches, so that a retracted or pulled-in state of the meniscus is maintained for a predetermined time. Therefore, the meniscus recoils, and an ink pressure wave within the pressure generating chamber 15 is inverted in its direction. At this time, the second contraction wave element (discharging element) 57 reaches the piezoelectric vibrator, so that the pressure generating chamber 15 is contracted and the meniscus 38 moves in the pushing direction. Following the second contraction element 57, the third holding element 58 reaches at the piezoelectric vibrator and maintains a contraction state of the pressure generating chamber 15 for a predetermined time. The result is that the meniscus 38 is positioned in a state that it projects forward beyond the edge of the nozzle orifice 13.

A quantity of projection of the meniscus 38 from the front edge of the nozzle orifice 13, which is caused by the large-dot driving pulse, is larger than that caused by the small-dot driving pulse. The reason for this is that a quantity of retraction of the meniscus 38, caused by the second expansion element 55 of the large-dot driving pulse, is smaller than that caused by the same of the small-dot driving pulse (FIG. 2(*c*)). As a result, an amount of ink large enough to form a large dot is separated from the meniscus, and jetted toward the recording medium in the form of an ink drop.

Thereafter, the damp element 59 reaches the piezoelectric vibrator, and impedes the movement of the meniscus 38 in the retracting direction to damp the fluctuation of the meniscus 38.

The fine-vibration pulse will be described. The first contraction element 51 of the fine-vibration pulse first reaches at the piezoelectric vibrator as shown in FIG. 6. In turn, the pressure generating chamber 15 contracts and the meniscus 38 gradually moves from the stationary position in the pushing direction. Subsequently, the first holding element 52 reaches, and maintains a contraction state of the pressure generating chamber 15 for a predetermined time. Therefore, the meniscus recoils, the direction of an ink pressure wave within the pressure generating chamber 15 is inverted, and the meniscus 38 moves in the retracting direction. The meniscus 38 retracts beyond the stationary position, the first expansion element 53 further moves the meniscus 38 in the retracting direction. Subsequently, no voltage variation occurs. Therefore, the meniscus 38 vibrates at given periods while gradually attenuating. Such vibration agitates ink in the vicinity of the meniscus 38 to prevent an viscosity of ink thereat from increasing.

As described above, the driving pulse generating section can generate, for each nozzle orifice 13, a small-dot driving pulse (first driving pulse) containing the first expansion element 53 and second expansion element 55 which appear in succession, a large-dot driving pulse (second driving pulse) containing the second expansion element 55, or a fine-vibration pulse for fluctuating the meniscus 38 in accordance with the print data D1 and D2. The print data D1 (D2) may be updated every print period for one-dot printing. Therefore, the dot size, a large dot or a small dot, can be selected every dot. In other words, a print containing large and small dots can be made through one printing operation (one main scanning). Therefore, there is eliminated the necessity of performing the printing operation every dot size (volume), and hence high speed printing is attained. Further, the printing of one printing line can be made through one printing operation, thereby preventing the displacement between the large dot and the small dot.

In the embodiment, a quantity of pull-in movement of the meniscus 38 is determined depending on selection of one or both of two successive expanding elements, the volume (size) of the ink drop is changed by changing the meniscus pull-in movement quantity. Therefore, the second expanding element causing the ejection of the ink drop may be used for both sizes of the dots. This makes it easy to secure exact landing center positions of small and large ink drops.

The fine-vibration pulse is applied to each nozzle orifice 13 which is not used for ejecting ink drops, to agitate ink in the vicinity of the meniscus 38. This function prevents the ink from increasing its viscosity.

Further, in the embodiment, to secure correct landing center positions of the large- and small-dot ink drops, the gradient (voltage gradient) θ2 of the voltage variation descending slope of the first expansion element 53 is smaller than the voltage gradient θ3 of the second expansion element 55 and the voltage gradient θ4 of the second contraction element 57. This will be described hereunder.

When the piezoelectric vibrator 14, assembled into the recording head 10, is deformed through the charging and discharging operations, the vibration (residual vibration) of the piezoelectric vibrator 14 is usually left after the charging/discharging operation ends. The residual vibration causes the pressure generating chamber 15 and the meniscus 38 to vibrate at the Helmholtz's resonance frequency. The amplitude of the vibration depends on a voltage gradient ($\Delta V/\Delta T$) at which the voltage is varied for charging and discharging the piezoelectric vibrator 14. The larger the voltage gradient is, the larger the amplitude of the vibration is. The larger a jetting velocity of the ink drop ejected is, the size (volume) of the ink drop more increases.

From the above fact, it is estimated that the larger the gradient θ2,θ3 or θ4 is, the residual vibration is more increased in amplitude and hence the jetting velocity of the ink drop ejected is higher. (θ2, θ3 and θ4 are the voltage gradients of the first expansion element 53, and the second contraction element 57 (FIG. 4)), and hence that if the voltage gradient is selected to be small, the residual vibration is not increased and hence the jetting velocity of the ink drop will be reduced.

From the above estimation, it will be seen that the jetting velocity of the ink drop can be controlled by adjusting the voltage gradient θ2,θ3 or θ4.

To secure correct landing center positions of the large- and small-dot ink drops, what a designer has to do is to set the voltage gradient at such a value that the jetting velocity of the large-dot ink drop is to be selected to be substantially equal to that of the small-dot ink drop.

Specifically, the recording head is designed such that the jetting velocities of the large- and small-dot ink drops are determined by use of the gradient θ3 of the second expansion element 55 and the gradient θ4 of the second contraction element 57, those wave elements being both used for the large- and small-dot ink drops.

In the present embodiment designed on the basis of the above-mentioned fact, the gradient θ2 of the first expansion element 53 not contained in the large-dot driving pulse is selected to be smaller than the gradient θ3 of the second expansion element 55 and the gradient θ4 of the second contraction element 57, minimizing its influence on the residual vibration. As a result, the embodiment succeeds in securing correct center positions of the large- and small-dot ink drops.

In the embodiment, the volume difference between the small-dot ink drop and the large-dot ink drop is determined by the potential difference (VP1−VM) between the start point of the first expansion element 53 and the connection element 54. It is easy to set the voltage difference (VP1−VM) at a large value, and hence it is easy to set the volume difference between the small- and large-dot ink drops. Therefore, the print quality can be improved while the printing speed is increased.

The first embodiment uses a driving signal of which the waveform is configured so as to contain the first contraction element 51 to the damp element 59. The waveform of the driving pulse may be configured in other ways. A second embodiment of the present invention to be described hereunder handles another driving signal having a waveform which is different in configuration from that handled in the first embodiment.

A waveform of the driving signal handled in the second embodiment is shown in FIG. 9. As shown, the driving signal waveform contains a first expansion element 61, a first connection element 62, a second connection element 63, a third connection element 64, a second expansion element 65, a fourth connection element 66, a third expansion element 67, a first holding element 68, a first contraction wave element (discharging element) 69, a second holding element 70 and a damp element 71.

The second expansion element 65, the fourth connection element 66 and the third expansion element 67 constitute an expansion wave element of the present invention; the second expansion element 65 serves as a first expanding element; the third expansion element 67 serves as a second expanding element; the fourth connection element 66 serves as a connecting element; and the first contraction element 69 serves as a contracting wave element.

The period of the driving signal consists of four divided periods T1 to T4. The wave segments within the periods T1, T3 and T4 can be selected. The print data thus consists of three bits (D1 to D3). The bit data D1 is used for selecting the wave segment in the period T1; the bit data D2 is for selecting the wave segment in the period T3; and the bit data D3 is for selecting the wave segment in the period T4. In the second embodiment, to select the wave segments in the periods T2 and T4, "011" is assigned to the print data, and to select the wave segments in the periods T1 and T4, "101" is assigned to the print data.

To generate a small-dot driving pulse (first driving pulse of the present invention) by use of the thus waveshaped driving signal, the wave segments in the periods T3 and T4 are selected. A waveform of a small-dot driving pulse generated is illustrated as a solid line in FIG. 10(*a*). As shown, the generated driving pulse contains the second expansion element 65, fourth connection element 66, third expansion element 67, first holding element 68, first contraction element 69, second holding element 70 and the damp element 71.

To generate a large-dot driving pulse (second driving pulse of the present invention) by use of the thus waveshaped driving signal, the wave segments in the periods T1 and T4 are selected. A waveform (part of which is indicated by a chain line) of a large-dot driving pulse generated is also illustrated in FIG. 10(*a*). As shown, the generated driving pulse contains the first expansion element 61, a third holding element 72, the fourth connection element 66, third expansion element 67, first holding element 68, first contraction element 69, second holding element 70, and the damp element 71.

When the small-dot driving pulse is applied to the piezoelectric vibrator, the second expansion element 65 and the third expansion element 67 successively expands the pressure generating chamber 15, and with the expanding, the meniscus 38 is continuously pulled in (retracted) toward the pressure generating chamber 15. The first contraction element 69, which subsequently appears, contracts the pressure generating chamber 15, and the meniscus 38 is pushed and ejected out of the nozzle orifice 13. In this case, a quantity of ink ejected is small since the meniscus that is relatively greatly pulled in is pushed out of the nozzle orifice 13. Accordingly, an ink drop of small volume is ejected through the nozzle orifice 13.

When the large-dot driving pulse is applied to the piezoelectric vibrator, the first expansion element 61 pulls in the meniscus 38 toward the pressure generating chamber (a chain line in FIG. 10(*b*)). The meniscus 38 recoils with the presence of the third holding element 72, and returns to a point near the circumferential edge of the orifice 13 of the nozzle. At instant that the meniscus 38 reaches that point, the third expansion element 67 expands the pressure generating chamber 15. In turn, the meniscus 38 is slightly pulled in. Thereafter, the first contraction element 69 contracts the pressure generating chamber 15, and the meniscus 38 is pushed out of the pressure generating chamber and ejected through the nozzle orifice 13. In this case, the pulled-in quantity of the meniscus 38 is not large, and hence the quantity of ink ejected is relatively large. Accordingly, an ink drop of such a volume as to form a large dot is ejected through the nozzle orifice 13.

As described above, the second embodiment of the present invention can generate both of the small-dot driving pulse and the large-dot driving pulse from the driving signal, and selectively apply either the small-dot driving pulse or the large-dot driving pulse every print period, which is for forming one dot. Resultant advantages are to increase the printing speed, and to secure correct landing center positions of the large- and small-dot ink drops.

While in each of the above-mentioned embodiments, the recording head 10 uses the piezoelectric vibrator 14 which vibrates in the flexural vibration mode, this type of the piezoelectric vibrator may be substituted by a piezoelectric vibrator which vibrates in the longitudinal vibration mode (d31 mode).

It will readily be understood that the present invention is applicable to the recording head of the so-called bubble jet type in which the air bubble is used for varying the volume of the pressure generating chamber.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A method of driving an ink jet recording head capable of ejecting plural kinds of ink drops having different volumes, comprising the steps of:

generating a driving signal repetitively including:

an expansion wave element for expanding a pressure generating chamber of the recording head, the expansion wave element composed of the first expanding element and a second expanding element which are successively arranged in order:

a first contraction wave element and a second contraction wave element for contracting the pressure generating chamber, respectively; and generating selectively either a first driving pulse or a second driving pulse from the driving signal in accordance with the volume of the ink drop to be ejected, the first driving pulse including the first and second expanding elements and the first and second contraction wave elements, the second driving pulse including the second expanding element and the second contraction wave element.

2. The driving method as set forth in claim 1, wherein the gradient of voltage variation of the first expanding element is smaller than that of the second expanding element and the contraction wave element.

3. The driving method as set forth in claim 1, wherein the expansion wave element further includes a connecting element for connecting the end point of the first expanding element and the start point of the second expanding element, and wherein a potential difference between the start point of the first expanding element and the connecting element defines a volume difference between the ink drops ejected by the first driving pulse and the second driving pulse.

4. The driving method as set forth in any of claims 1 to 3, wherein a third driving pulse for finely vibrating a meniscus of the ink drop such an extent as not to be ejected from the recording head is generated by composing of the first contraction wave element and the first expanding element.

5. The driving method as set forth in claim 1, wherein a potential difference between the end point of the second expanding element and the end point of the contraction wave element defines driving voltage of the driving signal.

6. The driving method as set forth in any of claims 1 to 3, wherein the volume of ink drop ejected by the first driving pulse is smaller than that ejected by the second driving pulse.

7. The driving method as set forth in claim 1, applied to an ink jet recording head in which a flexural vibration mode piezoelectric vibrator is used.

8. The driving method as set forth in claim 1, applied to an ink jet recording head in which a longitudinal vibration mode piezoelectric vibrator is used.

9. An apparatus for driving an inkjet recording head using a drive signal, said inkjet recording head being provided with pressure generating chambers, and with piezoelectric vibrators and nozzles corresponding to said pressure generating chambers, said piezoelectric vibrators being responsive to said drive signal and print data to change the volume of said corresponding pressure generating chambers for selectively ejecting ink drops from said corresponding nozzles during print periods, said apparatus comprising:

a drive signal generator generating said drive signal each print period;

said drive signal comprising a first drive pulse and a second drive pulse, wherein said first drive pulse is adapted to eject an ink drop of a first ink drop size at an ejection timing within said print period, and said second drive pulse is adapted to eject an ink drop of a second ink drop size greater than said first ink drop size at said ejection timing within said print period;

a pulse selector making a selection of a respective selected drive pulse for each of said pressure generating chambers during each print period, wherein said selection is based on said print data, when said print data indicates an ink drop of said first ink drop size, said first drive pulse is said respective selected drive pulse, and when said print data indicates an ink drop of said second ink drop size, said second drive pulse is said respective selected drive pulse; and a driver supplying said respective selected drive pulse to said piezoelectric vibrators corresponding to said pressure generating chambers.

10. The apparatus as set forth in claim 9, wherein:

said first drive pulse comprises respective wave elements, including an ejection element ejecting said ink drop of said first ink drop size;

said second drive pulse comprises respective wave elements, including an ejection element ejecting said ink drop of said second drop size; and said respective wave elements of said first drive pulse include all of said respective wave elements of said second drive pulse.

11. The apparatus as set forth in claim 10, wherein said ejection element in said respective wave elements of first drive pulse is identical to said ejection element in said respective wave elements of said second drive pulse.

12. The apparatus as set forth in claim 9, wherein:

said drive signal generated by said drive signal generator includes, in order:

a first contraction element causing a decrease in a present chamber volume of one of said pressure generating chambers, and a first expansion element causing an increase in said present chamber volume;

a second expansion element causing an increase in said present chamber volume, a second contraction element causing a decrease in said present chamber volume and ejecting an ink drop, and a damping element damping a meniscus vibration of ink in the vicinity of said nozzles;

said first contraction element and said first expansion element define a first pulse segment of said drive signal;

said second expansion element, said second contraction element, and said damping element define a second pulse segment of said drive signal;

when said first drive pulse is said respective selected drive pulse, said driver supplies said first pulse segment of said drive signal and supplies said second pulse segment of said drive signal; and when said second drive pulse is said respective selected drive pulse, said driver does not supply said first pulse segment of said drive signal but does supply said second pulse segment of said drive signal.

13. The apparatus as set forth in claim 12, wherein:

when said print data indicates no ink drop, said pulse selector selects a third drive pulse as said respective selected drive pulse so as to vibrate said meniscus without an ejection; and when said third drive pulse is said respective selected drive pulse, said driver supplies said first pulse segment of said drive signal but does not supply said second pulse segment of said drive signal.

14. The apparatus as set forth in claim 9, wherein said first drive pulse includes a first expansion element and a second expansion element, and said second drive pulse includes said second expansion element.

15. An inkjet printer driving apparatus, comprising:

a drive signal generator, a pulse selector, and means for driving a change in a present chamber volume of a chamber of an inkjet recording head, wherein said means for driving outputs a chamber driving signal;

said pulse selector making a drive pulse selection during each said print period based on print data, wherein when said print data indicates a small drop ejection, said pulse selector selects a first drive pulse, and when said print data indicates a large drop ejection, said pulse selector selects a second drive pulse;

said drive signal generator generating a drive signal in a recording period, said drive signal comprising, in order, a first pulse segment and a second pulse segment, wherein said second pulse segment includes an ejection element, and wherein said first pulse segment is free of any ejection element; and said means for driving receiving said drive signal and responding to said drive pulse selection so that, when said drive pulse selection is said first driving pulse, said chamber driving signal includes said first pulse segment and said second pulse segment, and when said drive pulse selection is said second driving pulse, said chamber driving signal does not include said first pulse segment but does include said second pulse segment.

16. The apparatus as set forth in claim 15, wherein:

said first pulse segment comprises, in order, a first contraction element for driving a decrease in said present chamber volume and a first expansion clement driving an increase in said present chamber volume; and said second pulse segment comprises, in order, a second expansion element driving an increase in said present chamber volume, a second contraction element driving a decrease in said present chamber volume and ejecting an ink drop, and a damping element driving a damping operation for a vibration of an ink meniscus in a nozzle vicinity of said recording head.

17. The apparatus as set forth in claim 16, wherein:

when said print data indicates no ink drop, said pulse selector selects a third drive pulse;

when said drive pulse selection is said second driving pulse, said chamber driving signal out by said means for driving does include said first pulse segment but does not include said second pulse segment.

* * * * *